United States Patent [19]

Hackmann et al.

[11] Patent Number: 4,946,076

[45] Date of Patent: Aug. 7, 1990

[54] DISPENSER FOR PASTY COMPOSITIONS

[75] Inventors: Ludger Hackmann; Josef Wilken, both of Lohne/Oldenburg, Fed. Rep. of Germany

[73] Assignee: Bramlage Gesellschaft mit beschränkter Haftung, Lohne/Oldenburg, Fed. Rep. of Germany

[21] Appl. No.: 252,523

[22] Filed: Oct. 3, 1988

[30] Foreign Application Priority Data

Oct. 2, 1987 [DE] Fed. Rep. of Germany ..... 3733354

[51] Int. Cl.[5] ..... B65D 37/00

[52] U.S. Cl. ..... 222/207; 222/209; 222/212; 222/260; 222/319; 222/340; 222/378; 222/380; 222/385; 222/387; 222/405

[58] Field of Search ..... 222/207, 209, 212, 252, 222/387, 378, 380, 385, 386, 383, 256, 260, 340, 383, 319, 405

[56] References Cited

U.S. PATENT DOCUMENTS

| | | | |
|---|---|---|---|
| 4,394,939 | 7/1983 | Thor et al. | 222/207 |
| 4,402,431 | 9/1983 | Wiegner et al. | 222/207 |
| 4,732,549 | 3/1988 | von Schuckmann | 222/207 X |
| 4,775,080 | 10/1988 | Mettenbrink | 222/405 X |
| 4,776,496 | 10/1988 | Battegazzore | 222/209 |
| 4,807,784 | 2/1989 | Jupin et al. | 222/207 |
| 4,846,372 | 7/1989 | von Schuckmann | 222/209 X |

FOREIGN PATENT DOCUMENTS

| | | | |
|---|---|---|---|
| 0097972 | 6/1983 | Fed. Rep. of Germany . | |
| 3416999 | 11/1985 | Fed. Rep. of Germany . | |
| 0266284 | 10/1987 | France | 222/207 |

*Primary Examiner*—Joseph J. Rolla
*Assistant Examiner*—Kenneth DeRosa
*Attorney, Agent, or Firm*—Martin A. Farber

[57] ABSTRACT

A dispenser for pasty compositions, having a housing within which a piston displaceable in only the direction of emptying is arranged. An actuator enables a headpiece to act on a restorable wall which can be pressed in the direction towards the piston, the headpiece having a dispenser outlet opening. The wall forms an outlet tube the opening of which is coordinated to the outlet opening, and on which opening a stopper is formed which closes the outlet opening. The outlet opening is formed in the front side actuator and the actuator can act on the wall by means of the lever transmission.

20 Claims, 3 Drawing Sheets

DISPENSER FOR PASTY COMPOSITIONS

FIELD AND BACKGROUND OF THE INVENTION

The present invention relates to a dispenser for pasty compositions having a housing within which a piston displaceable only in the direction of emptying is arranged and which has an actuator by means of which it is possible to act on a restorable wall of a headpiece, the wall being capable of being pressed in the direction towards the piston, said headpiece having a dispenser outlet opening, said wall forming an outlet tube the opening of which is associated with the outlet opening, and on which opening a stopper is formed which closes the outlet opening.

As the headpiece there is designated the outlet-opening-side region between the dispenser outlet opening and wall which contains the functional parts of the mechanism. From the standpoint of flow said region is bridged over by said outlet tube.

A dispenser of the above type forms the object of the Unpublished Patent Application P 3,708,713.4. To be sure, in that case the actuator lies on the side. Its horizontal movement of displacement is diverted by 90° and thus converted into a downward movement. An angle member which is pivoted at its vertex serves for this purpose.

Furthermore it is known from EP 97,972 to arrange the actuator on the front side of the headpiece. The handle is developed at the same time as a pump bellows. Arranged offcenter, also lying on the front side, the tube is shaped on the headpiece, the tube having an outlet opening at its end for the pasty composition.

Federal Republic of Germany OS 3,416,999 actuator is arranged from the restorable wall. The actuator is a mushroom-like or cupula-like actuator, which is held by means of a collar on a small tube that extends upward above the wall. The dispenser outlet opening is closed by a stopper which is seated on a protective cap which covers everything. Practically the entire cross-sectional area of the handle is available for actuating the discharge. The necessity of again closing the opening by a stopper constitutes a certain disadvantage.

SUMMARY OF THE INVENTION

The object of the present invention is to create a dispenser of this type in a form which is simple to manufacture and of optimal utility, i.e., in particular, easy to operate.

As a result of the development in accordance with the invention, there is obtained a dispenser of this type which is of increased utilitarian value: in particular, it assures convenience in operation. Even very pasty fillings can be spontaneously discharged with the application of only slight force. Due to the fact that the outlet opening is formed in the actuator on the front side, the actuator operates as a scraper surface or, depending on its shape, at the same time as an applicator. In this connection, the actuating button is a release button outside of the region of the outlet opening and is at the same time part of a force-displacement lever transmission which acts on the wall. The displacement of the stopper which is effected via this mechanism takes place with the downward movement of the actuator and therefore in the same direction as and furthermore ahead of the valve-seat surface which is moved with it.

A structurally advantageous solution results from the fact that the actuator has an action projection by means of which it is possible to act on a lever-like transmission part which, in its turn, displaces the wall. All of this can be achieved in an extremely compact arrangement. Short actuating paths are sufficient. Particularly for a dispenser mechanism of rotational symmetry it is advantageous that the action projection is developed as an actuating ring. Therefore equally justified actuating conditions are present on all sides. A particularly stable solution results if the lever-like transmission part is developed in the shape of a disk. Favorable conditions with respect to the force-displacement transmission principle result from a development in which the disk has substantially the same diameter as the actuator. The movement of attack on the wall which accordingly is oriented as centrally as possible, results from the fact that the lever-like transmission part acts, in the foot region and adjacent to the tube, on the wall. It is favorable in this connection that the disk be developed in the manner of a cup spring with the cone open towards the actuator. Such a transmission part can even have an initial tension and thus further support the restorability of the wall. Furthermore, it then holds the actuating button, in particular independent of tolerances, at all times in its stop-limited basic position. An advantageous further development then results when the disk acts on the wall via a hub-like section which is formed by a film hinge on the disk. Despite the tilting displacement of the actuator, a component of force which is oriented along the longitudinal central axis of the dispenser is thus always introduced. Furthermore, the invention proposes that the bottom the resting surface of larger diameter for the disk, holds the wall and a non-return valve which separates the pump space from the supply space. This leads to a structurally advantageous multiple function of such a bottom, the further development of which also is that the bottom forms the abutment for the actuator. There may be here a snap-under engagement, so that its mounting is limited to a simple clipping. With respect to the wall, possibilities of shaping may also be utilized for the restoring force, in addition to a specific selection of material, in the manner that the wall is developed in dome shape. It extends in dome-like manner over the region of the non-return valve. With respect to the centrally oriented construction of the dispenser mechanism, one advantageous further development also is that the axis of the tube and the axis of the valve coincide. With respect to the discharge of the contents in separate portions as well as the corresponding delivery requirement, a development is advantageous in which the valve is approximately twice the diameter of the tube. Finally, it is also proposed that the distance from the wall to the bottom corresponds approximately to one-half of the diameter of the valve. As an alternative, it is proposed that the disk be developed in the form of a wheel-spoke member. This not only has the advantage of saving of material, which is of particular importance in the case of mass production articles, but also of an improved spring characteristic.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
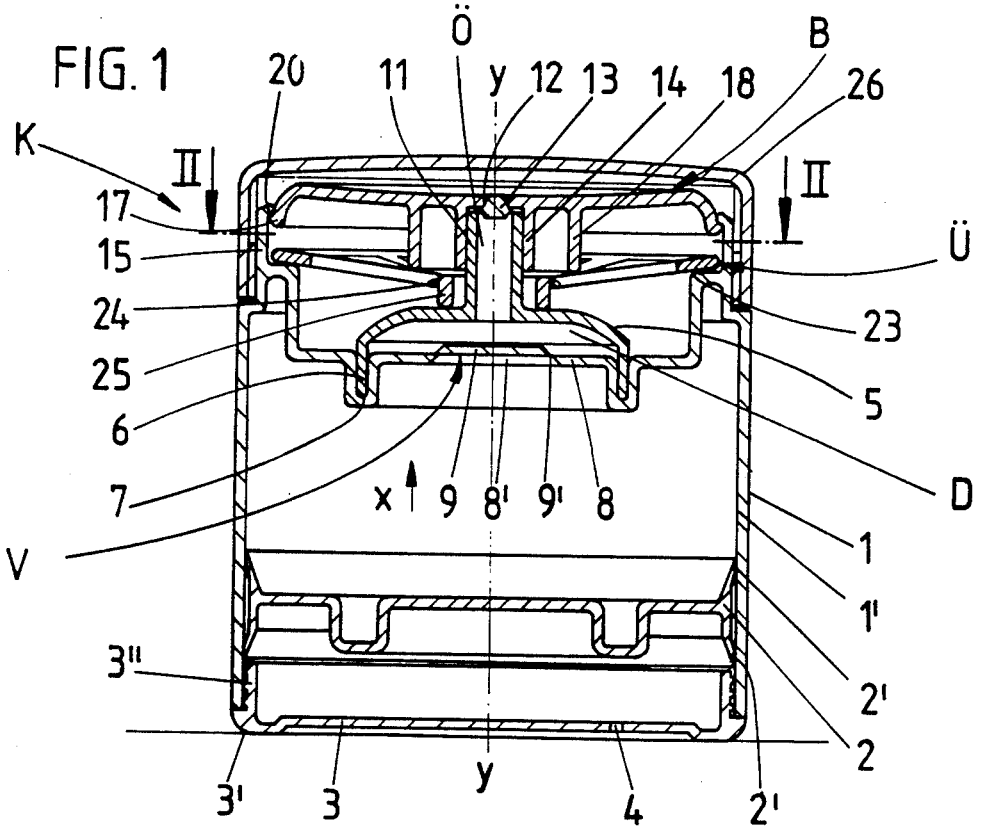
FIG. 1 shows the dispenser of the invention in a vertical section, in the basic closed position.
Figure 2:
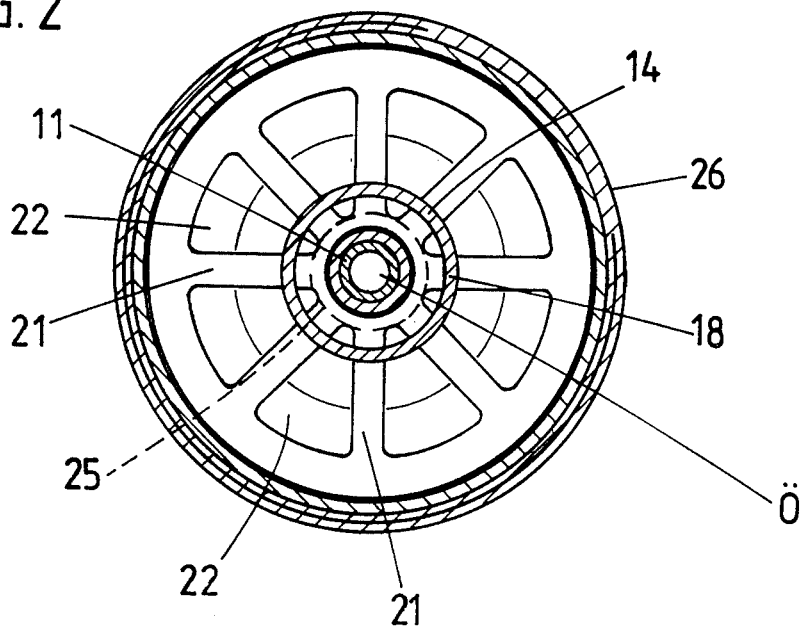
FIG. 2 is a section along the line II—II of FIG. 1.

The cylindrically developed housing 1 of the dispenser contains a piston 2. The oppositely directed edge lips 2' of the piston are guided on the cylindrical inner wall 1' of the housing.

The housing 1 is closed on the bottom by a bottom part 3 forming a standing base 3'. On the bottom part 3 there is developed an inner collar 3'', the end surface of which extends so far into the housing 1 that it extends up to directly in front of the piston 2. Furthermore, the bottom part 3 has an eccentric opening 4 for air equalization upon the displacement of the piston, which takes place in upward direction.

The housing 1 is filled with the headpiece K facing downward. In order that the air contained between the piston 2 and the filling material can escape, the initial region of the housing inner wall 1' is provided, for instance, with longitudinal grooving.

The piston 2 can be displaced only in the direction of emptying (arrow x).

On the end opposite the bottom part 3 and therefore the upper end, the housing 1 has a bellows-like wall 5 which restores itself in spring-like manner and can be pressed in the direction of the piston 2. This wall is of dome shape and is therefore arched slightly upward in dome-like manner. On its periphery the wall changes into a clamping ring 6. This is a cylindrical wall section which is formed simultaneously on the wall 5 upon the forming of the latter. The wall section grips from above in sealing fashion into an annular groove 7 in a bottom 8 which divides off the upper pump space as well as the dispenser mechanism from the supply space contained below same. Said bottom 8 is a multistep partition wall section with centrally located non-return valve V, the valve flap 9 of which, connected via a film hinge 9', is freely bridged over with axial and radial spacing by the wall 5. The corresponding zone between the wall 5 and the bottom 8 forms the dosaging space D.

The central region of the wall 5 continues in an upwardly directed outlet tube 11 for the discharge of the metered amount of filling material. This outlet tube is of circular cross section. The opening O of the outlet tube 11 faces an outlet opening 12. Said outlet opening 12 of the headpiece K lies namely center of an actuator B of the dispenser. The outlet opening 12 is closed in the basic position to the outlet tube 13 by a stopper 13. The latter extends above the top end edge of the outlet tube 11 and is of conical shape. The corresponding mating contour, in the manner of an annular, funnel-shaped sealing surface, is located on the outlet opening 12. The stopper 13 is connected by radial arms, not shown in detail. With respect to the detailed description of the development, the details described and shown in Patent Application P 3,708,713.4 are incorporated in full herein. The axis of the outlet tube 11 coincides with the axis of symmetry of the valve and with the longitudinal center axis y—y of the dispenser, which is developed so that it can stand up.

As can be seen, in the closed position of the stopper 13 the front end there of the outlet tube 11 is recessed with respect to the corresponding inside edge zone of the outlet opening 12, so that the closing application of the outer wall of the stopper in the outlet opening 12 is assured in all cases.

The outlet tube 11 is guided in a socket 14 of the actuator B. The socket 14 extends from the bottom of the plate-shaped, slightly depressed actuator approximately over half the axial length of the outlet tube 11. For easier plug-type connection, the inner edge of the cylindrical socket 14 is beveled.

The bottom 8 continues in the upper part of the headpiece K in a freestanding annular wall 15. The front end thereof is slightly pulled inward and thus forms an abutment 16 for the plate-shaped actuator, which is inserted by way of the clip arrangement. An outwardly directed annular shoulder 17 with peripheral run-oh bevel for easy plug attachment of the actuator forms a part of the abutment 16 on the actuator side. The application is established by the restoring force of the wall 5 forming a pump bellows, with the utilization of the outlet tube 11 or its stopper 13 as a connecting bridge.

The non-return valve V, which extends in tightly sealing manner over the valve opening 8, and the bottom 8 and its opening 8', has a diameter which corresponds to approximately twice the inside diameter of the outlet tube 11. The axial distance between wall 5 and the section of the bottom 8 below it corresponds to about one half of the diameter of the valve flap 9' or valve opening 8, of the non-return valve V.

The actuation of the pump-chamber wall 5 is effected with initial pulling of the stopper 13 from its corresponding closure surface of the outlet opening 12 by the exerting of a slight tilting movement of the actuator B as well as with facilitated actuation due to an interposed lever transmission. For this purpose, an action projection 18 is associated with the actuator on the inner side facing the wall 5. This projection is a collar which is arranged concentrically around the socket 14 and protrudes freely in the same direction. The action projection 18 lies above a lever-like transmission part Ü. The latter lies over the wall 5 and displaces it upon the exerting of a force P on the edge region of the actuator B. The rim edge opposite the actuating region defines an articulation or tilt point 20 in the region of the stationary abutment 16.

The transmission part Ü is developed substantially in disk shape. This disk has an outside diameter which corresponds approximately to that of the actuator B, which is also circular in contour.

The lever-like transmission part Ü acts in the region of the foot, namely in neighboring position to the outlet tube 11, on the wall 5.

Specifically, the disk is an injection molded part, for instance of plastic, having a rather shallow cone open towards the actuator. In practice it is formed like a wheel-spoke member. The spokes 21 alternate at equal angular spacings with openings 22 therebetween.

The edge of the disk-shaped transmission part Ü rests on a shoulder-like resting surface 23. The latter is formed by the corresponding shape of a higher section of the bottom 8. It is developed as a horizontal annular shoulder of a radial width which corresponds approximately to the "rim section" of the wheel-spoke member. The spokes 21 adjoining the inside of this member come together in a hub-like section 25 which is formed centrally on the disk. This section is a short tubular body, the lower end of which rests on the back of the wall 5. The inside diameter of the hub-like section 25 is larger than the outside diameter of the socket 14, so that a larger active radial support for the outlet tube 11 could be utilized with respect to this socket. The lower end edge, like the periphery of the disk, is transversely rounded. The section 25 extends downward beyond the thickness of the spokes. The connection to the hub-like section 25 is effected by film hinges 24 of reduced cross section.

The manner of operation of the dispenser described may be briefly summarized as follows: After removal of a cap 26 which can be attached to the housing 1 by a threaded or plug-type connection, pressure is exerted on the actuator B in the direction indicated by the arrow P. The corresponding sidewise actuation leads to a tilting of the plate-shaped actuator around the diametrically opposite point of tilt 20. By means of the action projection 18, the movement is transmitted to the transmission part Ü and, via the latter, to the metering part, i.e., the wall 5. The pasty composition, for instance cream, now passes, as a result of the reduction of volume within the dosaging space D, through the outlet tube 11 which acts as conduit bridge while passing through the outlet opening 12 in the center of the actuator, B, since during the course of the displacement of the actuator the stopper 13 has come, superimposed or in leading fashion, out of the outlet opening 12 (see FIG. 4). The automatic mechanical withdrawal of the stopper 13 is effected in this case via the force-displacement transmission which has been described. The radii-set transmission can be noted from FIG. 3. Upon a downward displacement within the region of the entering force P by 2 mm the edge-supported lever-like transmission part Ü tilts downward in opposite radius and the same reference plane as the action projection 18 and, like the latter, by 1.5 mm. This results in a movement coefficient in the center of 2.5 mm for the wall 5, referred to the region of the longitudinal central axis y—y, and despite the displacement in the same direction of the actuator, leads to an opening stroke of the stopper 13 of 1 mm. The actuating stroke of 2 mm has been selected as example and it will, in actual practice, be about 4 mm.

Figure 3:
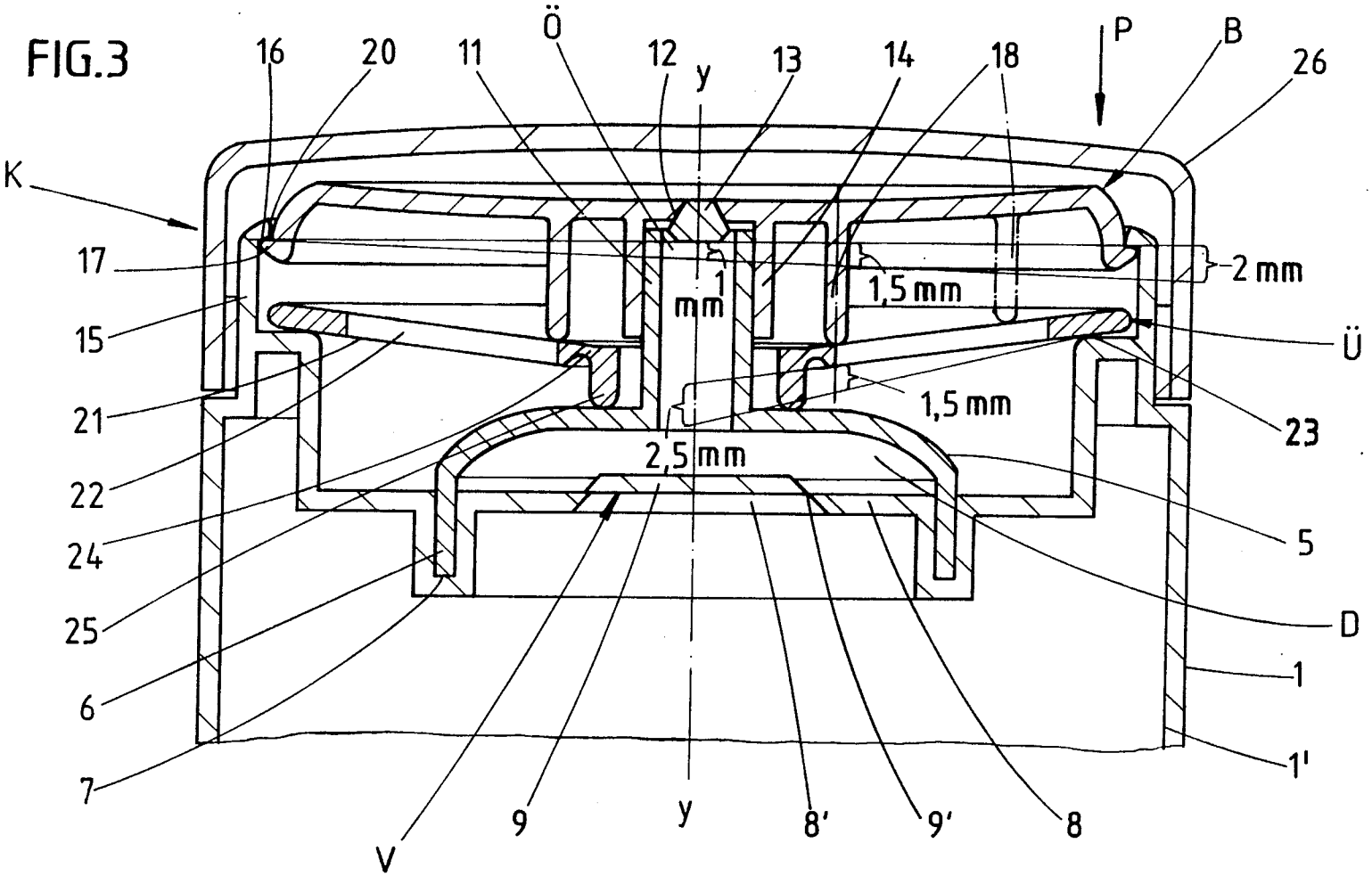
FIG. 3 is an enlarged view of the upper part of FIG. 1.
Figure 4:
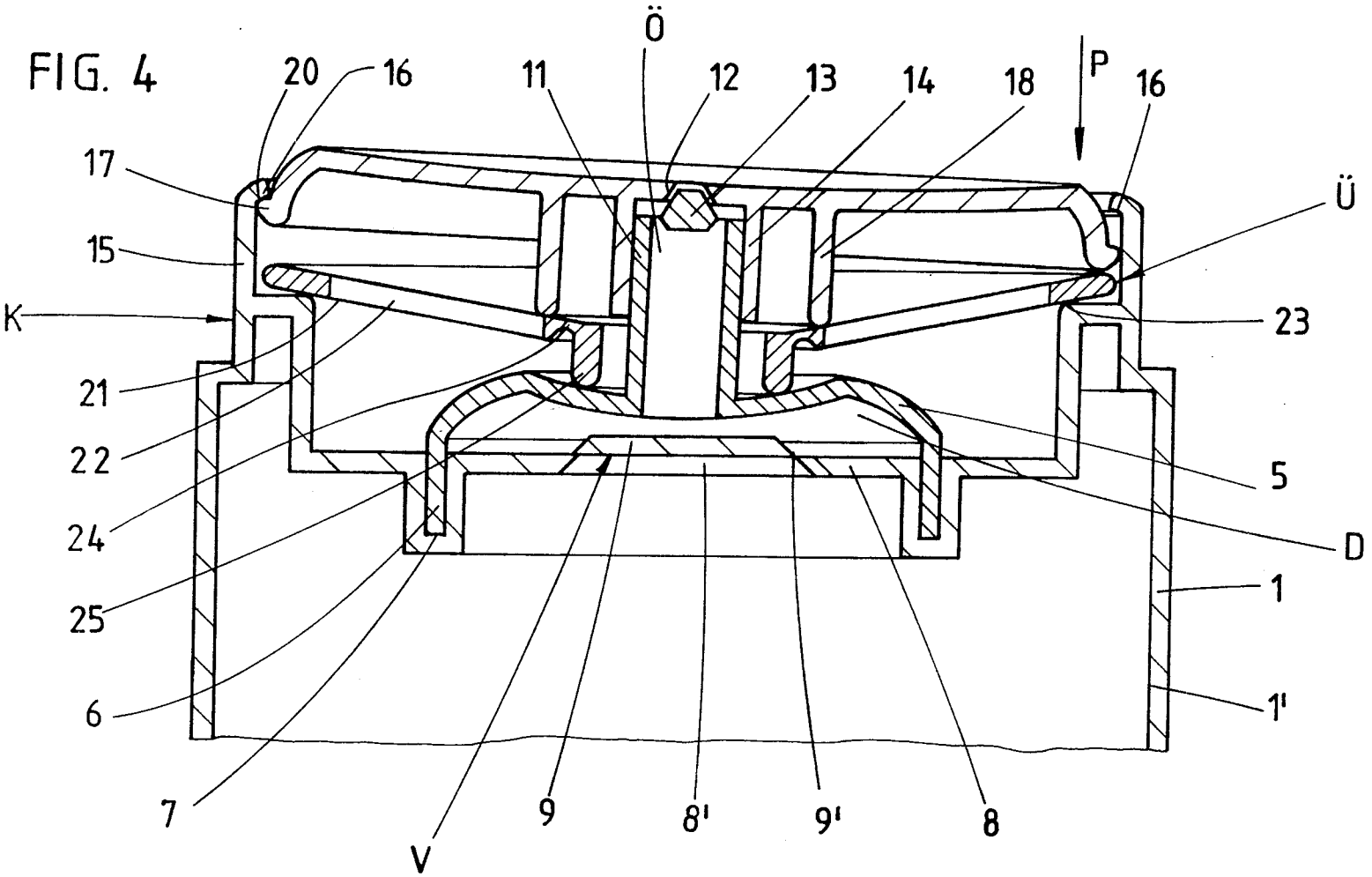
FIG. 4 shows the dispenser head upon discharge actuation.

The conditions in the force-displacement region can naturally also be varied, as shown by the movement study of FIG. 3, in accordance with the viscosity of the filling material.

With actuation of the actuator, the non-return valve V closes, pressing in tightly sealing manner against the top edge region of the valve opening 8'. Upon relaxation of the wall 5 and therefore the return of the bellows-shaped body into the initial position shown in FIG. 1, on the other hand, a vacuum is produced in the metering space D. Accordingly, the valve flap 9 rises upwardly, swinging around its lateral film hinge 9'. Filling material is thus drawn in. Hand in hand with this, the piston 2 moves upwardly over the column of filling material one step in the direction towards the headpiece K. There is no drawing-in of leakage there through the relatively narrow annular slot of the outlet opening 12 since, on the one hand, the stopper goes increasingly into its closed position and, on the other hand, the material present in the relatively long tube 11 in itself acts as a sort of closure stopper. The recovery of the wall 5 is therefore always completed before air could act to equalize the volume in the metering in space D.

The bellows (wall 5) participates in the slight lateral movement.

We claim:

1. A dispenser for pasty contents, comprising a housing, a piston disposed in said housing displaceable in only a direction of emptying of the contents, a restorable wall which is pressable in a direction towards the piston, the wall forming an outlet tube having an opening coordinated with an outlet opening of the dispenser, said dispenser outlet opening being disposed above said outlet tube, a stopper formed on said outlet tube at said opening of the outlet tube, said stopper releaseably closes the outlet opening of the dispenser by resting from below against the outlet opening of the dispenser, an actuator on an upper front side of said housing having said outlet opening of the dispenser formed therein at the upper front side, said actuator is spaced apart from said restorable wall, means comprising a lever transmission, said actuator via said means comprising said lever transmission presses on said wall.

2. A dispenser according to claim 1, wherein said wall has a dome shape.

3. A dispenser according to claim 1, wherein said lever transmission comprises a lever-like transmission part, the latter being a separate part from that of said actuator and that of said wall and being arranged therebetween, and said actuator has an action projection, the latter being actable on said lever-like transmission part which, in turn, displaces said wall.

4. A dispenser according to claim 3, wherein said action projection is formed as an actuating ring.

5. A dispenser according to claim 3, wherein said lever-like transmission part has a disk shape.

6. A dispenser according to claim 3, wherein said lever-like transmission part acts on said wall in a foot region adjacent to the outlet tube.

7. A dispenser according to claim 6, wherein said lever-like transmission part has a hub, said hub being formed as an actuating ring acting on said restorable wall.

8. A dispenser according to claim 7, wherein said lever transmission comprises a lever-like transmission part having a circumferential pivot on said housing and engages said wall by said actuating ring at an engagement place coaxially around said outlet tube.

9. A dispenser according to claim 8, wherein said actuator has a collar which engages said lever-like transmission part coaxially to and between said engagement place and said circumferential pivot.

10. A dispenser according to claim 9, wherein said actuator has a tilt point on said housing and undergoes a lever-like pivot movement when pressed.

11. A dispenser according to claim 3, wherein said lever-like transmission comprises a disk, and wherein said disk has substantially the same diameter as that of the actuator.

12. A dispenser according to claim 11, further comprising a bottom forming a resting surface of larger diameter than and for said disk, said resting surface holds the wall and forms a non-return valve which separates a pump space from a storage space of the housing.

13. A dispenser according to claim 12, wherein said bottom forms an abutment for said actuator.

14. A dispenser according to claim 12, wherein the axis of the outlet tube and the axis of the non-return valve coincide.

15. A dispenser according to claim 12, wherein the non-return valve is of approximately twice the diameter of the outlet tube.

16. A dispenser according to claim 12, wherein the distance from said wall to said bottom is about half the diameter of said non-return valve.

17. A dispenser according to claim 12, wherein said bottom is connected to said housing.

18. A dispenser for pasty contents, comprising
a housing,
a piston disposed in said housing displaceable in only a direction of emptying of the contents,
a restorable wall which is pressable in a direction towards the piston, the wall forming an outlet tube having an opening coordinated with an outlet opening of the dispenser,
a stopper formed on said outlet tube at said opening of the outlet tube, said stopper releaseably closes the outlet opening,
an actuator on a front side of said housing having said outlet opening formed therein,
a lever transmission,
said actuator via said lever transmission presses on said wall,
said lever transmission comprises a lever-like transmission part,
said actuator has an action projection, the latter being actable on said lever-like transmission part which, in turn, displaces said wall,
said lever-like transmission comprises a disk, and wherein said disk has substantially the same diameter as that of the actuator, and
the disk comprises a cup spring defining a cone open towards said actuator.

19. A dispenser for pasty contents, comprising
a housing,
a piston disposed in said housing displaceable in only a direction of emptying of the contents,
a restorable wall which is pressable in a direction towards the piston, the wall forming an outlet tube having an opening coordinated with an outlet opening of the dispenser,
a stopper formed on said outlet tube at said opening of the outlet tube, said stopper releaseably closes the outlet opening,
an actuator on a front side of said housing having said outlet opening formed therein,
a lever transmission,
said actuator via said lever transmission presses on said wall,
said lever transmission comprises a lever-like transmission part,
said actuator has an action projection, the latter being actable on said lever-like transmission part which, in turn, displaces said wall,
said lever-like transmission comprises a disk, and wherein said disk has substantially the same diameter as that of the actuator, and
said disk acts on said wall by a hub-like section formed on the disk via a film hinge of the wall.

20. A dispenser for pasty contents, comprising
a housing,
a piston disposed in said housing displaceable in only a direction of emptying of the contents,
a restorable wall which is pressable in a direction towards the piston, the wall forming an outlet tube having an opening coordinated with an outlet opening of the dispenser,
a stopper formed on said outlet tube at said opening of the outlet tube, said stopper releaseably closes the outlet opening,
an actuator on a front side of said housing having said outlet opening formed therein,
a lever transmission,
said actuator via said lever transmission presses on said wall,
said lever transmission comprises a lever-like transmission part,
said actuator has an action projection, the latter being actable on said lever-like transmission part which, in turn, displaces said wall,
said lever-like transmission comprises a disk, and wherein said disk has substantially the same diameter as that of the actuator, and
the disk is developed as a wheel-spoke member.

* * * * *